United States Patent [19]

Stone et al.

[11] 4,137,813

[45] Feb. 6, 1979

[54] FINGERBOARD ATTACHMENT FOR STRINGED INSTRUMENTS

[75] Inventors: Thomas D. Stone, Fairfield, Iowa; Michael J. Felgen, San Rafael; Heiko T. de Man, Gualala, both of Calif.

[73] Assignee: Intonation Systems, Fairfield, Iowa

[21] Appl. No.: 894,306

[22] Filed: Apr. 7, 1978

[51] Int. Cl.[2] ..... G10D 3/06

[52] U.S. Cl. ..... 84/314

[58] Field of Search ..... 84/297, 298, 307, 314

[56] References Cited

U.S. PATENT DOCUMENTS

| | | | |
|---|---|---|---|
| 1,554,802 | 9/1925 | Dyer | 84/314 |
| 3,398,622 | 8/1968 | Smith | 84/314 X |
| 4,064,780 | 12/1977 | Bond | 84/314 |

FOREIGN PATENT DOCUMENTS

| | | | |
|---|---|---|---|
| 22871 of | 1900 | United Kingdom | 84/314 |
| 10803 of | 1901 | United Kingdom | 84/314 |
| 21764 of | 1905 | United Kingdom | 85/314 |

*Primary Examiner*—Lawrence R. Franklin

*Attorney, Agent, or Firm*—Townsend and Townsend

[57] ABSTRACT

A stringed musical instrument with fixed frets is provided with the capability of employing more than one tonal scale. At least two fretted fingerboards are provided with frets located at different relative positions on the respective fingerboards. A transversely opening groove is formed on the instrument beneath and parallel to the strings. On the underside of each fingerboard, a corresponding groove is provided which opens transversely with respect to the fingerboard. Each of the fingerboards can be mounted to the instrument when desired by engaging the groove on the selected fingerboard with the corresponding groove on the instrument. A mechanism is provided for forcing the grooves together so that the fingerboard is secured to the instrument in a releasable fashion.

13 Claims, 6 Drawing Figures

22
23
21
54
20
19
18
13
12
55
14
15
56
16
10

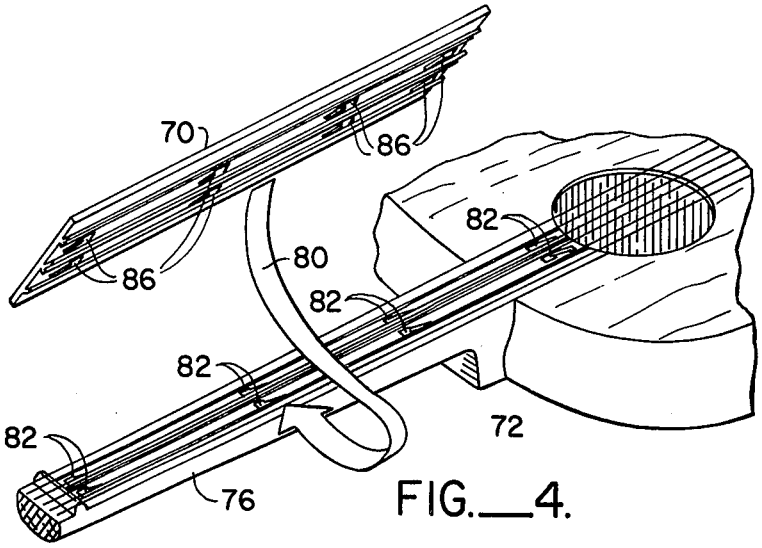
FIG._4.
FIG._5.
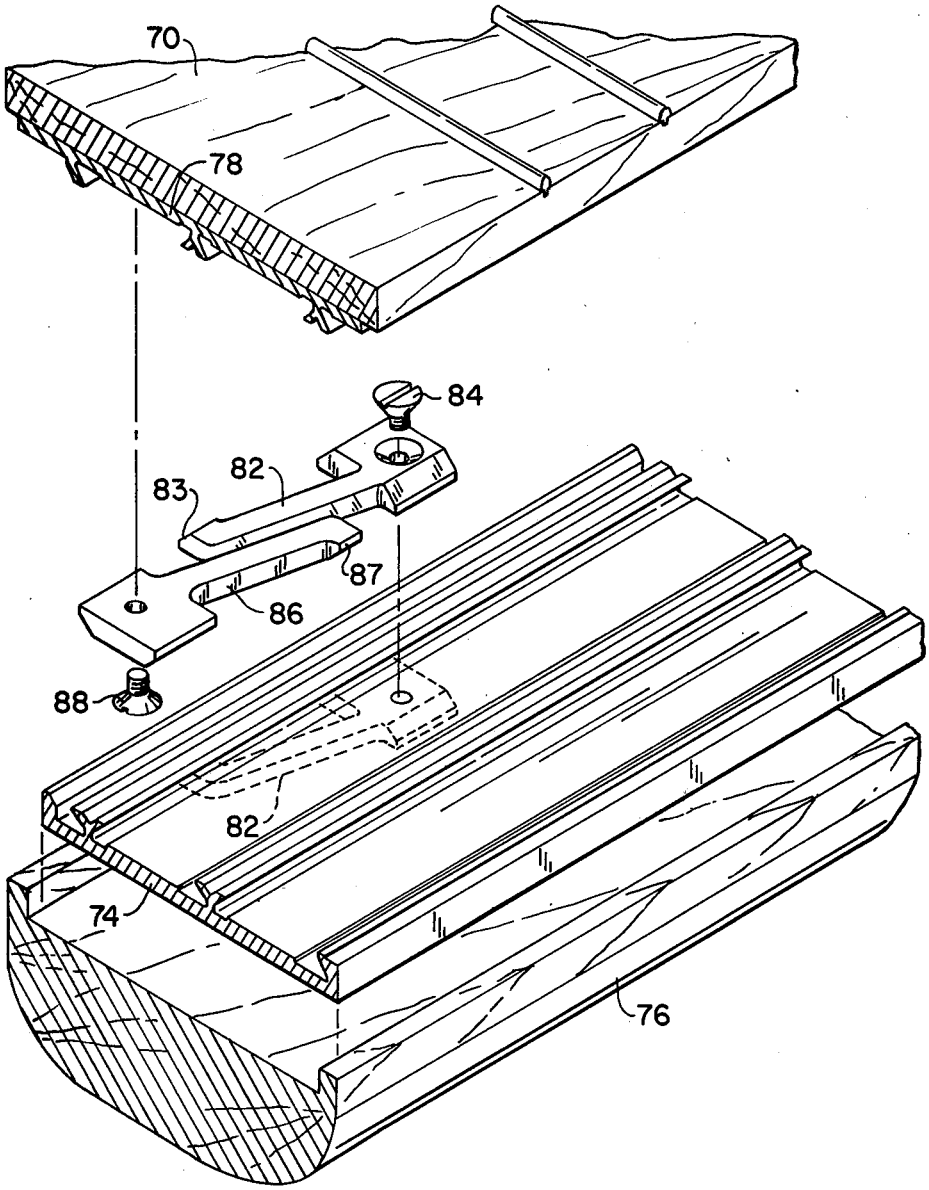

FINGERBOARD ATTACHMENT FOR STRINGED INSTRUMENTS

BACKGROUND OF THE INVENTION

The present invention relates to apparatus for providing a stringed musical instrument with the capability of operating on multiple tonal scales.

Stringed instruments such as guitars, banjos, electric bass guitars, and the like typically have a fingerboard underlying the strings which contains a plurality of fixed non-movable frets. The individual playing the instrument uses his fingertips to press the strings against the frets on the fingerboard to change the effective length of the string and thereby select the tone generated when the string is vibrated. The location of the frets on the fingerboard provides a fixed set of tones which can be generated on any one instrument. The available tones from such an instrument is called its tonal scale.

The music which can be played on a stringed instrument having fixed frets is limited to the specific tones included in the tonal scale of that instrument. This limitation is acceptable for music which is written specifically for an instrument having a particular tonal scale, but the instrument cannot be used to play other forms of music which require tones not included in the instrument's tonal scale. Instruments are available which have movable frets, such as the sitar. However, the operation of the movable frets in such an instrument is quite difficult and the incorporation of movable frets in standard fixed fret instruments is impractical.

The present invention provides a stringed musical instrument with fixed frets with the capability of employing more than one tonal scale. At least two fretted fingerboards are provided with frets located at different relative positions on the respective fingerboards. A transversely opening groove is formed on the instrument beneath and parallel to the strings. On the underside of each fingerboard, a corresponding groove is provided which opens transversely with respect to the fingerboard. Each of the fingerboards can be mounted to the instrument when desired by engaging the groove on the selected fingerboard with the corresponding groove on the instrument. A mechanism is provided for forcing the grooves together so that the fingerboard is secured to the instrument in a releasable fashion.

By providing a plurality of fingerboards with frets located in different positions, each fingerboard being individually attachable to the instrument, a stringed instrument with fixed frets can be played on different tonal scales, greatly increasing the flexibility of the instrument and allowing it to play different types of music. With the apparatus of the present invention, the selected fingerboard can readily be located in place on the instrument by engaging the respective transverse grooves on the fingerboard and the instrument. The grooves are then forced together to secure the fingerboard to the instrument. When a different tonal scale is desired, the fingerboard on the instrument can readily be detached therefrom and an alternate fingerboard secured to the instrument.

A critical problem in mounting a fingerboard to a stringed instrument in a detachable fashion is the vibration of the fingerboard if it is not securely attached to the instrument. In stringed instruments, the quality of the instrument depends on its ability to transfer sound from the neck of the instrument on which the fingerboard is located to the body. Any vibration which occurs in the instrument at the neck, such as would be caused by a fingerboard improperly secured thereto, causes a loss of sound energy, particularly at high frequencies. This loss of energy flattens the sound and may degrade its quality of such an extend that the instrument is an undesirable alternative to standard fixed fretted instruments.

The present invention provides a mechanism for mounting the removable fingerboard to the instrument by engaging corresponding grooves on the instrument and the fingerboard respectively. The grooves themselves are forced together to secure the fingerboard to the instrument, minimizing and virtually eliminating vibration of the fingerboard relative to the instrument which would detract from the quality of the instrument. As a result, stringed instruments can be provided with multiple tonal scales without sacrificing their quality.

The novel features which are characteristic of the invention, as to organization and method of operation, together with further objects and advantages thereof will be better understood from the following description considered in connection with the accompanied drawings which preferred embodiments of the invention are illustrated by way of example. It is to be expressly understood, however, that the drawings are for the purposes of illustration and description only and are not intended as a definition of the limits of the invention.

BRIEF DESCRIPTION OF THE DRAWINGS

FIG. 4 is a fragmentary perspective view of a guitar and fingerboard according to the second embodiment of the present invention;

FIG. 5 is a fragmentary exploded view of the second embodiment of the present invention illustrating the mechanism by which the fingerboards are secured to the guitar.

DESCRIPTION OF THE PREFERRED EMBODIMENTS

Figure 1:
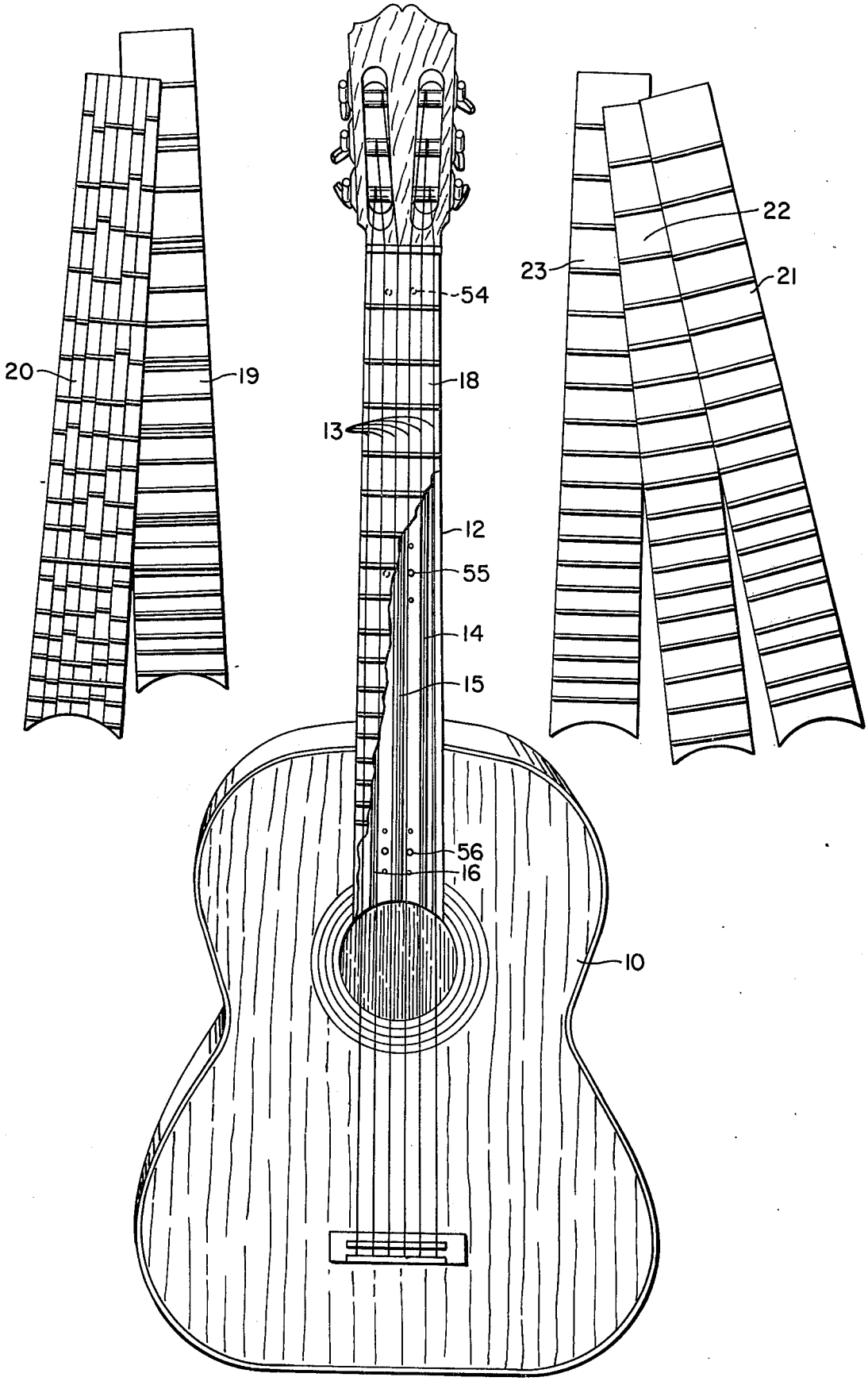
FIG. 1 is a perspective view of a guitar together with a plurality of fingerboards attachable thereto constructed in accordance with the present invention.

A guitar 10 constructed in accordance with the teachings of the present invention is depicted in FIG. 1. Ordinarily, guitar 10 would be provided with a fingerboard having a plurality of fixed frets which is molded into and forms an integral part of the neck 12 of guitar 10. The guitar is played by the performer by pressing the strings 13 against the frets of the fingerboard with his fingertips to establish their effective length and thus the tone generated. Guitar 10 is provided with a plurality of ribs 14–16 in place of the standard integral fingerboard.

in the present invention, a plurality of movable fingerboards 18–23 are provided which each have a plurality of frets located on different relative positions on the respective fingerboards. As described in more detail hereinafter, fingerboards 18–23 are capable of being individually engaged with ribs 14–16 on guitar 10. Since the location of the frets on the respective fingerboards are different, each fingerboard will provide guitar 10 with a different set of tones which can be produced when the strings are pressed against the frets of the fingerboards, allowing the guitar to be played on different tonal scales.

Although a guitar is illustrated as a representative instrument having a fixed fretted fingerboard (as opposed to movable fretted instruments such as the sitar), it is to be understood that the present invention is applicable to other fixed fretted stringed instruments as well, the guitar being used merely for purposes of illustration.

Figure 2:
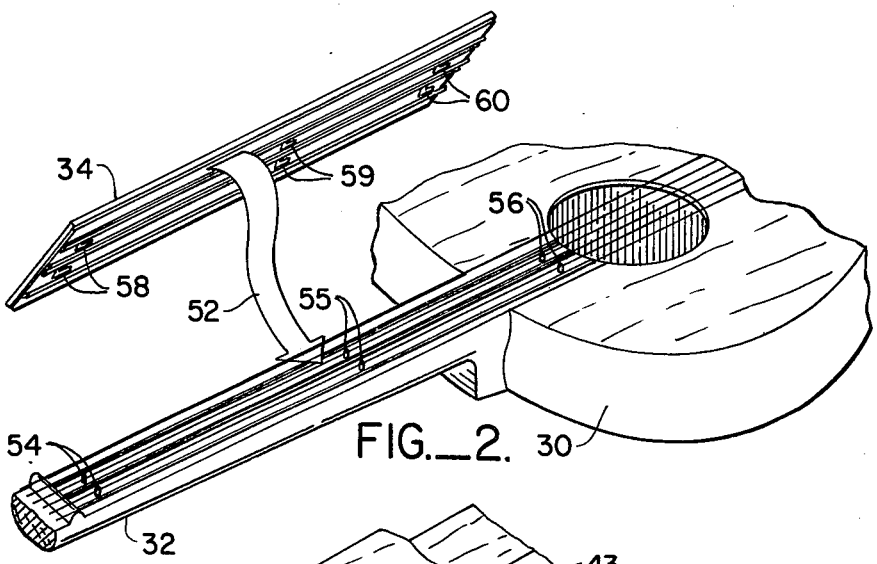
FIG. 2 is a fragmentary perspective view of a guitar and fingerboard constructed according to the first embodiment of the present invention.
Figure 3A:
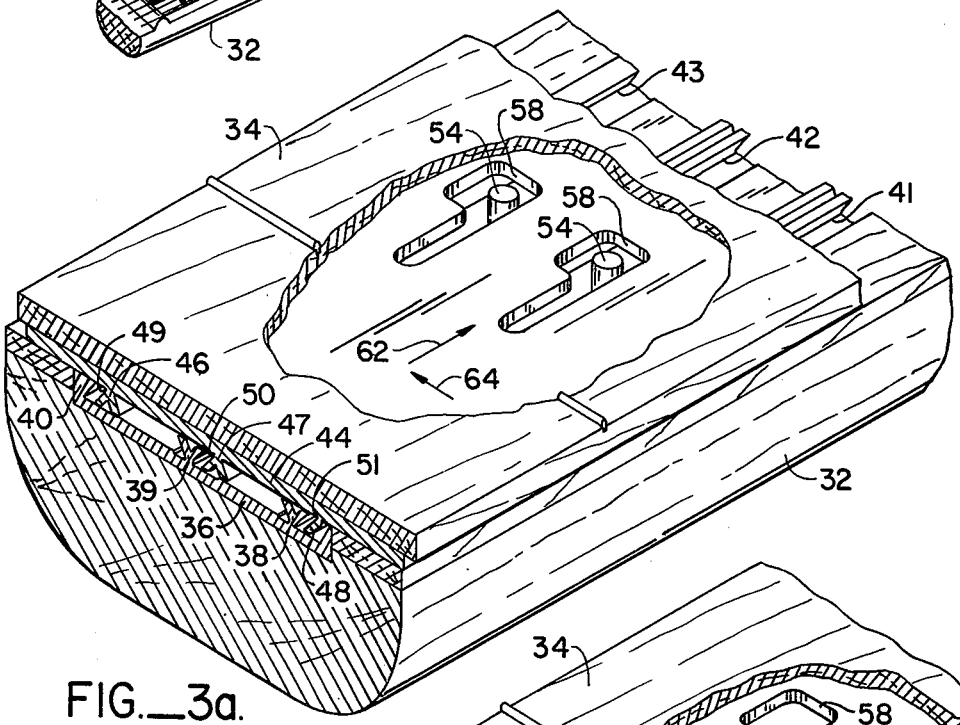
FIGS. 3a and 3b are fragmentary views of the guitar and fingerboard of the first embodiment of the present invention illustrating the mechanism by which the fingerboards are secured to the guitar.
Figure 3B:
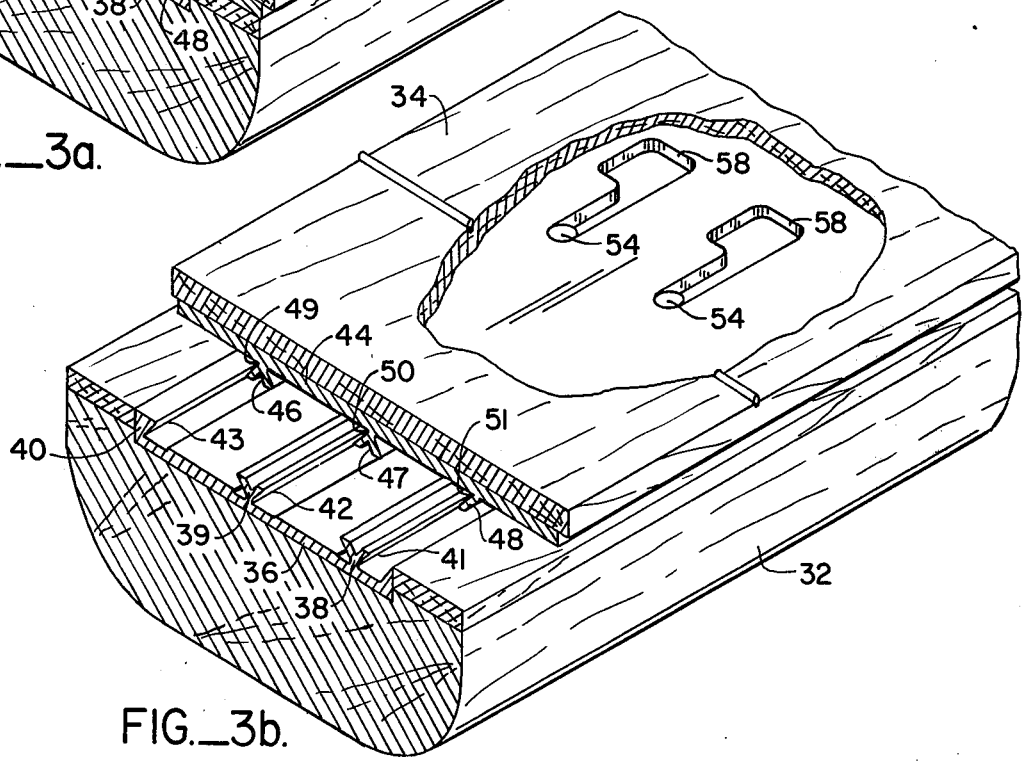

A guitar 30 with neck 32 and a plurality of fingerboards such as fingerboard 34 constructed according to the first embodiment of the present invention is illustrated by way of reference to FIGS. 2, *3a* and *3b*. Nested in the neck 32 of guitar 30 is an aluminum channel extrusion 36. Channel extrusion 36 includes a pair of Y-shaped ribs 38, 39 and a third rib 40 extending upwardly with respect to neck 30 which define a set of grooves 41, 42, and 43 which open transversely (i.e., in a sideward direction) relative to neck 32.

The underside of each fingerboard such as 34 is provided with an aluminum plate extrusion 44 fixed to and incorporated as part of the fingerboard. A pair of Y-shaped ribs 46, 47 and a third rib 48 define transversely opening grooves 49–51. Fingerboard 34 is mounted on guitar neck 32 by locating the fingerboard on top of the neck beneath the strings as illustrated by arrow 52, and moving the fingerboard transversely to engage the grooves 41–43 on the guitar neck with grooves 49–51 of the fingerboard to mount the fingerboard to the guitar neck.

In the first embodiment of the present invention, guitar 30 is provided with a plurality of sets of dowel pins 54–56 extending upwardly from channel extrusion 36 at selected intervals along its length. Extrusion plate 44 on the underside of fingerboard 34 is provided with pairs of slots 58–60 at locations corresponding to the placement of dowel pins 54–56 respectively.

Each of the slots such as 58 has a wide end and a narrow end. When fingerplate 34 is placed on top of guitar neck 30 as illustrated in FIG. *3a*, but before it is moved transversely as depicted in FIG. *3b*, dowel pins such as 54 are received within the large end of slots 58. Fingerboard 34 is then slid longitudinally as depicted by arrows 62 so that the dowel pins such as 54 move toward the narrow end of slots 58. As the dowel pins 54 reach the narrow end of slots 58, fingerboard 34 is forced to move transversely as depicted by arrow 64 to force the grooves 49–51 on the underside of the fingerboard into contact with corresponding grooves 41–43 on the guitar. Fingerboard 34 can be removed by sliding it in the opposite direction and replaced with another.

A second embodiment of the present invention is illustrated by way of reference to FIGS. 4 and 5. Again, a plurality of removable fingerboards such as fingerboard 70 are attachable to a guitar 72. A channel extrusion 74 is located on guitar neck 76 and a plate extrusion 78 is located on the underside of fingerboard 70 identical to the extrusion channel 36 and extrusion plate 44 of the first embodiment. The grooves of the selected fingerboard 70 are engaged with those of guitar 72 as illustrated by arrow 80 in a fashion identical to that depicted in the first embodiment to mount the fingerboard to the guitar.

Sets of resilient armatures 82 are attached to channel extrusion 74 by a screw such as 84. Corresponding sets of flexible, resilient armatures 86 are attached to the underside of plate extrusion 78 by screws such as 88. Armatures 82, 86 are each inclined at an acute angle relative to the axis of the guitar neck 76 and fingerboard 70. When fingerboard 70 is slid longitudinally along guitar neck 76, armatures 82 and 86 engage and force one another apart. The tapered ends 83, 87 of armatures 82, 86 are thus forced into engagement with corresponding ribs on channel extrusion 74 and plate extrusion 78 to secure the fingerboard to guitar 72.

In each of the above two embodiments illustrated, the guitar and a plurality of fingerboards are provided with corresponding transverse grooves by which the fingerboard can be located on the neck of the guitar. The grooves are defined by ribs which extend the length of the fingerboard and corresponding portion of the guitar neck. The fingerboards are slid longitudinally and an engagement mechanism is provided which forces the grooves of the fingerboard against those of the guitar to secure the fingerboard to the guitar along its entire length. As a result, vibration of the fingerboard mounted to the guitar is substantially prevented, and the tone quality of the guitar is not materially affected.

While preferred embodiments of the present invention have been illustrated in detail, it is apparent that modifications and adaptations of those embodiments will occur to those skilled in the art. However, it is to be expressly understood that such modifications and adaptations are within the spirit and scope of the present invention, and set forth in the following claims:

What is claimed is:

1. Apparatus for providing a stringed musical instrument with at least two different tonal scales comprising:

at least two fretted fingerboards;

a plurality of frets located on each of said fingerboards, said frets located at least partially at different relative positions on the respective fingerboards;

means on said instrument underlying the strings thereof for defining at least one groove generally parallel to said strings and opening transversely to said strings;

means on the underside of each of said fingerboards for defining at least one groove opening transversely to said respective fingerboards so that any one of said fingerboards can be attached to said instrument by placing the selected fingerboard beneath the strings of the instrument and moving the selected fingerboard transversely to engage the groove defining means on the selected fingerboard with the groove defining means of the instrument; and means for forcing the groove defining means of the selected fingerboard against the groove defining means of the instrument to secure the selected fingerboard to the instrument, said forcing means being releasable for removal of said selected fingerboard from the instrument and replacement with another.

2. Apparatus as recited in claim 1 wherein the forcing means comprise at least two dowel pins projecting upwardly from the instrument beneath the strings thereof, and at least a pair of slots corresponding to said dowel pins, said slots having a wide end and a narrow end so that upon sliding of the selected fingerboard in a first direction longitudinally with respect to the said instrument, the dowel pins engage the sides of the slots as the pins move to the narrow ends of the slots to force the groove defining means of the selected fingerboard against the groove defining means of the instrument to secure the selected fingerboard to the instrument, said selected fingerboard being readily releasable from the instrument by sliding the selected fingerboard in the opposite direction to said first direction.

3. Apparatus as recited in claim 1 wherein the forcing means comprises at least two flexible resilient armatures attached to the instrument beneath the strings and extending at an acute angle to the groove defining means of the instrument, and corresponding sets of two flexible resilient armatures located on the underside of each of the fingerboards and disposed at an acute angle with respect to the axis of said fingerboards, the flexible armatures on the selected fingerboard adapted to engage the respective armatures on the instrument upon sliding of said selected fingerboard longitudinally with respect to said instrument, said armatures being forced apart and into engagement with the groove defining means of the fingerboard and the instrument when the selected fingerboard is slid in a first direction longitudinally with respect to the instrument to secure the selected fingerboard to the instrument, said selected fingerboard being readily releasable from the instrument by sliding the selected fingerboard in the opposite direction to said first direction.

4. Apparatus as recited in claim 1 wherein said groove defining means of each said fingerboard comprises means for defining a plurality of said grooves, and wherein the groove defining means on the instrument comprises means for defining a corresponding plurality of said grooves.

5. Apparatus as recited in claim 1 wherein the groove defining means of each said fingerboard extends substantially the entire length of said fingerboard.

6. Apparatus as recited in claim 1 wherein said forcing means comprises means for forcing the groove defining means of the selected fingerboard against the groove defining means of the instrument as the selected fingerboard is slid in a first direction longitudinally with respect to the instrument to secure the selected fingerboard to the instrument, said forcing means being releasable for removal of said selected fingerboard from the instrument upon sliding of the fingerboard in a second direction opposite to said first direction.

7. Apparatus for providing a stringed musical instrument with at least two different tonal scales comprising:

at least two fretted fingerboards, said frets located at least partially at different relative positions on the respective fingerboards;

a plurality of ribs on said instrument underlying the strings thereof, said ribs defining a plurality of grooves generally parallel to and opening transversely to said strings;

a plurality of ribs on the underside of each of the fingerboards, said ribs defining a plurality of grooves opening transversely to said respective fingerboards so that any one of the fingerboards can be attached to said instrument by placing the selected fingerboard beneath the strings of the instrument and moving the selected fingerboard transversely to engage the grooves defined by the ribs on the fingerboard with the grooves defined by the ribs on the instrument; and means for forcing the ribs of the selected fingerboard against the ribs of the instrument to secure the selected fingerboard to the instrument, said forcing means being releasable for removal of said selected fingerboard from the instrument and replacement with another.

8. Apparatus as recited in claim 7 wherein the forcing means comprises at least two dowel pins projecting upwardly from the instrument beneath the strings thereof, and at least a pair of slots corresponding to said dowel pins, said slots having a wide portion and a narrow portion so that upon sliding of the selected fingerboard in a first direction longitudinally with respect to said instrument, the dowel pins engage the sides of the slots and the pins move to the narrow ends of the slots to force the ribs of the selected fingerboard against the rib of the instrument to secure the selected fingerboard to the instrument, said selected fingerboard being readily releasable from the instrument by sliding the selected fingerboard in the opposite direction to said first direction.

9. Apparatus as recited in claim 7 wherein the forcing means comprises at least two flexible resilient armatures attached to the instrument beneath the strings and extending at an acute angle to the ribs of the instrument, and corresponding sets of two flexible resilient armatures located on the underside of each of the fingerboards and disposed at an acute angle with respect to the axis of said fingerboards, the flexible armatures on the selected fingerboard adapted to engage the respective armatures on the instrument upon sliding of said selected fingerboard in a first direction longitudinally with respect to said instrument so that said armatures are forced apart and into engagement with the ribs of the fingerboard and the instrument to secure the selected fingerboard to the instrument, said selected fingerboard being readily releasable from the instrument by sliding the selected fingerboard in the opposite direction to said first direction.

10. Apparatus as recited in claim 7 wherein said forcing means comprises means for forcing the ribs of the selected fingerboard against the ribs of the instrument as the selected fingerboard is slid in a first direction longitudinally with respect to the instrument to secure the selected fingerboard to the instrument, said forcing means being releasable for removal of said selected fingerboard from the instrument upon sliding of the fingerboard in a second direction opposite to said first direction.

11. Apparatus for providing a stringed musical instrument with at least two different tonal scales comprising:

at least two fretted fingerboards, said frets located at least partially at different relative positions on the respective fingerboards;

means on said instrument underlying the strings thereof for defining at least two grooves generally parallel to and opening transversely to said strings;

means on the underside of each said fingerboards for defining at least two grooves opening transversely to said respective fingerboards so that any one of said fingerboards can be attached to said instrument by placing on the selected fingerboard beneath the strings of the instrument and moving the selected fingerboard transversely to engage the grooves on the selected fingerboard with the grooves of the instrument;

at least two dowel pins projecting upwardly from the instrument beneath the strings thereof; and at least two slots in each said fingerboard corresponding to said dowel pins, said slots having a wide portion and a narrow portion so that upon sliding of the selected fingerboard longitudinally in a first direction with respect to said instrument, the dowel pins engage the sides of the slots as the pins move toward the narrow portion of said slots to force the grooves of the selected fingerboard against the grooves of the instrument to secure the selected fingerboard to the instrument, said selected fingerboard being slid in a second direction opposite from said first direction and the grooves disengaged to remove the selected fingerboard from the instrument for replacement with another.

12. An improvement in a stringed instrument in which the instrument is adapted to utilize discrete fingerboards having frets located at least partially at different relative positions on the respective fingerboards, each fingerboard having on the underside thereof at least one groove opening transversely to the respective fingerboard, said improvement comprising means on said instrument underlying the strings thereof for defining at least one groove generally parallel to said strings and opening transversely to said strings so that any one of the fingerboards can be attached to said instrument by placing the selected fingerboard beneath the strings of the instrument and moving the selected fingerboard transversely to engage the groove defining means on the selected fingerboard with the groove defining means of the instrument; and means for forcing the groove defining means of the selected fingerboard against the groove defining means of the instrument to secure the selected fingerboard to the instrument, said forcing means being releasable for removal of said selected fingerboard from the instrument and replacement with another.

13. A fingerboard adapted to be attached to a stringed musical instrument having a groove underlying the strings of said instrument normally parallel to said strings and opening transversely to said strings, said fretted fingerboard comprising means on the underside of said fingerboard for defining at least one groove opening transversely to the fingerboard so that the fingerboard can be attached to the instrument by placing the fingerboard beneath the strings of the instrument and moving the fingerboard transversely to engage the groove defining means on the selected fingerboard with the groove of the instrument; and means for forcing the groove defining means of the fingerboard against the groove of the instrument to secure the fingerboard to the instrument, said forcing means being releasable for removal of the fingerboard from the instrument.

* * * * *